US010604283B2

(12) United States Patent
Anand et al.

(10) Patent No.: US 10,604,283 B2
(45) Date of Patent: Mar. 31, 2020

(54) FORMER ASSEMBLY WITH IMPROVED CENTER OF GRAVITY

(71) Applicant: Frito-Lay North America, Inc., Plano, TX (US)

(72) Inventors: Ashish Anand, Frisco, TX (US); Vibhav Jindal, Gurgaon (IN)

(73) Assignee: Frito-Lay North America, Inc., Plano, TX (US)

( * ) Notice: Subject to any disclaimer, the term of this patent is extended or adjusted under 35 U.S.C. 154(b) by 377 days.

(21) Appl. No.: 15/606,295

(22) Filed: May 26, 2017

(65) Prior Publication Data

US 2018/0339460 A1 Nov. 29, 2018

(51) Int. Cl.
*B29C 65/06* (2006.01)
*B65B 9/22* (2006.01)
*B65B 59/04* (2006.01)

(52) U.S. Cl.
CPC ..... *B65B 9/22* (2013.01); *B65B 59/04* (2013.01)

(58) Field of Classification Search
USPC ..... 53/302
See application file for complete search history.

(56) References Cited

U.S. PATENT DOCUMENTS 4,117,647 A * 10/1978 Rossi ..... B65B 9/20 53/502
4,118,913 A * 10/1978 Putnam, Jr. ..... B65B 9/2028 53/551
4,576,588 A * 3/1986 Umeda ..... B65B 59/00 53/551
4,796,409 A * 1/1989 Rimmer ..... B26D 1/205 53/438
5,537,798 A * 7/1996 Fukuda ..... B65B 9/20 53/168
5,979,512 A * 11/1999 McGregor ..... B65B 1/32 53/502
6,047,528 A 4/2000 Scholin
6,131,367 A * 10/2000 Fukuda ..... B65B 9/22 53/201
6,428,457 B1 * 8/2002 Fukuda ..... B65B 9/20 493/302
6,813,871 B2 11/2004 Kurth
7,152,387 B2 12/2006 Taylor
7,415,809 B2 8/2008 Taylor
(Continued)

*Primary Examiner* — Michelle Lopez
*Assistant Examiner* — Chinyere J Rushing-Tucker
(74) *Attorney, Agent, or Firm* — Barnes & Thornburg LLP; G. Peter Nichols

(57) ABSTRACT

A novel system and apparatus for bagmaking is disclosed herein. In particular, a former assembly is described which includes a collar flange having an aperture passing through from a first side to a second side. A wing assembly, which is mounted to the collar flange, has a former wing and a crown tube. The crown tube extends at least partially through the aperture of the collar flange. The former assembly also includes a transition tube having an elongate cylindrical body that passes through the crown tube and the aperture of the collar flange. A set of handles extends from the collar flange towards an upstream end of the elongate cylindrical body. Additionally, the former assembly has a center of gravity, determined from a reference coordinate system, with a y-component that is not further than 43 mm from the y-axis.

21 Claims, 9 Drawing Sheets

(56) References Cited

U.S. PATENT DOCUMENTS

| | | | | |
|---|---|---|---|---|
| 7,523,597 | B2 | 4/2009 | Dominguez | |
| 8,739,504 | B2 | 6/2014 | Willey | |
| 8,959,897 | B2 | 2/2015 | Iwasaki | |
| 9,102,426 | B2 | 8/2015 | Edwards | |
| 2003/0050166 | A1* | 3/2003 | Dominguez, Jr. | B65B 9/20 493/296 |
| 2009/0241478 | A1 | 10/2009 | Kettner | |
| 2009/0288376 | A1* | 11/2009 | Ichikawa | B65B 9/20 53/551 |
| 2010/0037568 | A1* | 2/2010 | Hashimoto | B65B 9/22 53/551 |
| 2011/0011864 | A1 | 1/2011 | Hofman | |
| 2012/0233970 | A1 | 9/2012 | Taylor | |
| 2012/0270711 | A1 | 10/2012 | Dominguez | |
| 2012/0285128 | A1* | 11/2012 | Kamigaito | B65B 51/26 53/548 |
| 2013/0165305 | A1 | 6/2013 | Taylor | |
| 2013/0165306 | A1 | 6/2013 | Grus | |
| 2016/0159543 | A1 | 6/2016 | Bierschenk | |
| 2016/0193783 | A1* | 7/2016 | Thaerigen | B29C 65/08 156/367 |

* cited by examiner

FORMER ASSEMBLY WITH IMPROVED CENTER OF GRAVITY

BACKGROUND

Technical Field

The present disclosure relates generally to an improved bagmaker. More particularly, the disclosure provides for a redesigned former assembly that addresses the deficiencies in conventional former assembly designs.

Background

Pillow pouches are bags that store breakable food pieces, such as potato chips and pretzels. These fragile food pieces are protected from breakage by a bubble of trapped air. Pillow pouches may be formed by conventional bagmakers, such as vertical form, fill, and seal machines. Generally, the bags are formed from a roll of film stock that is placed under tension then wrapped around a former assembly of the vertical form, fill, and seal machine to transition the flat film into a tube-like shape. Seams are added to the film tube form a partially enclosed bag, which is then filled with product before the bag is sealed and separated from the film tube.

A bagmaker can be modified to create bags of different sizes by changing the size of the film and also the former assembly. Changing the former assembly is a difficult task because existing former assemblies are heavy and bulky with an offset center of gravity relative to its handles, which makes it difficult to control. In addition, former assemblies are typically installed at a location above shoulder-height, which compounds those effects. As a result, conventional former assemblies are difficult to control and are often damaged during the removal and installation process, and during transportation. Over time, incidental damage yields wear patterns that result in former assembly misalignment, which produces deformed bags with imperfect seals and unacceptable barrier properties.

SUMMARY OF THE INVENTION

In a first embodiment, the disclosure relates to a former assembly that includes a collar flange having an aperture passing through from a first side of the collar flange to a second side of the collar flange. A wing assembly, which has a curved wing and a crown tube, is mounted to the collar flange. The crown tube extends at least partially through the aperture of the collar flange. A transition tube having an elongate cylindrical body passes through the crown tube and the aperture of the collar flange, and a set of handles extends from the collar flange towards an upstream end of the elongate cylindrical body. The former assembly has a center of gravity, as determined from a reference coordinate system with an origin located at a midpoint of the set of handles, which has a y-component that is not greater than 40 mm from the y-axis.

In a second embodiment, the disclosure relates to an improved bagmaker with a base plate and a former assembly slidably attached to the base plate. The former assembly includes a collar flange having an aperture passing through from a first side of the collar flange to a second side of the collar flange. A wing assembly, which has a curved wing and a crown tube, is mounted to the collar flange. The crown tube extends at least partially through the aperture of the collar flange. A transition tube having an elongate cylindrical body passes through the crown tube and the aperture of the collar flange, and a set of handles extends from the collar flange towards an upstream end of the elongate cylindrical body. The former assembly has a center of gravity, as determined from a reference coordinate system with an origin located at a midpoint of the set of handles, which has a y-component that is not greater than 40 mm from the y-axis.

Other aspects, embodiments and features of the invention will become apparent from the following detailed description of the invention when considered in conjunction with the accompanying drawings. The accompanying figures are schematic and are not intended to be drawn to scale. In the figures, each identical or analogous component that is illustrated in various figures is represented by a single numeral or notation. For purposes of clarity, not every component is labeled in every figure. Nor is every component of each embodiment of the invention shown where illustration is not necessary to allow those of ordinary skill in the art to understand the invention.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Figure 1:
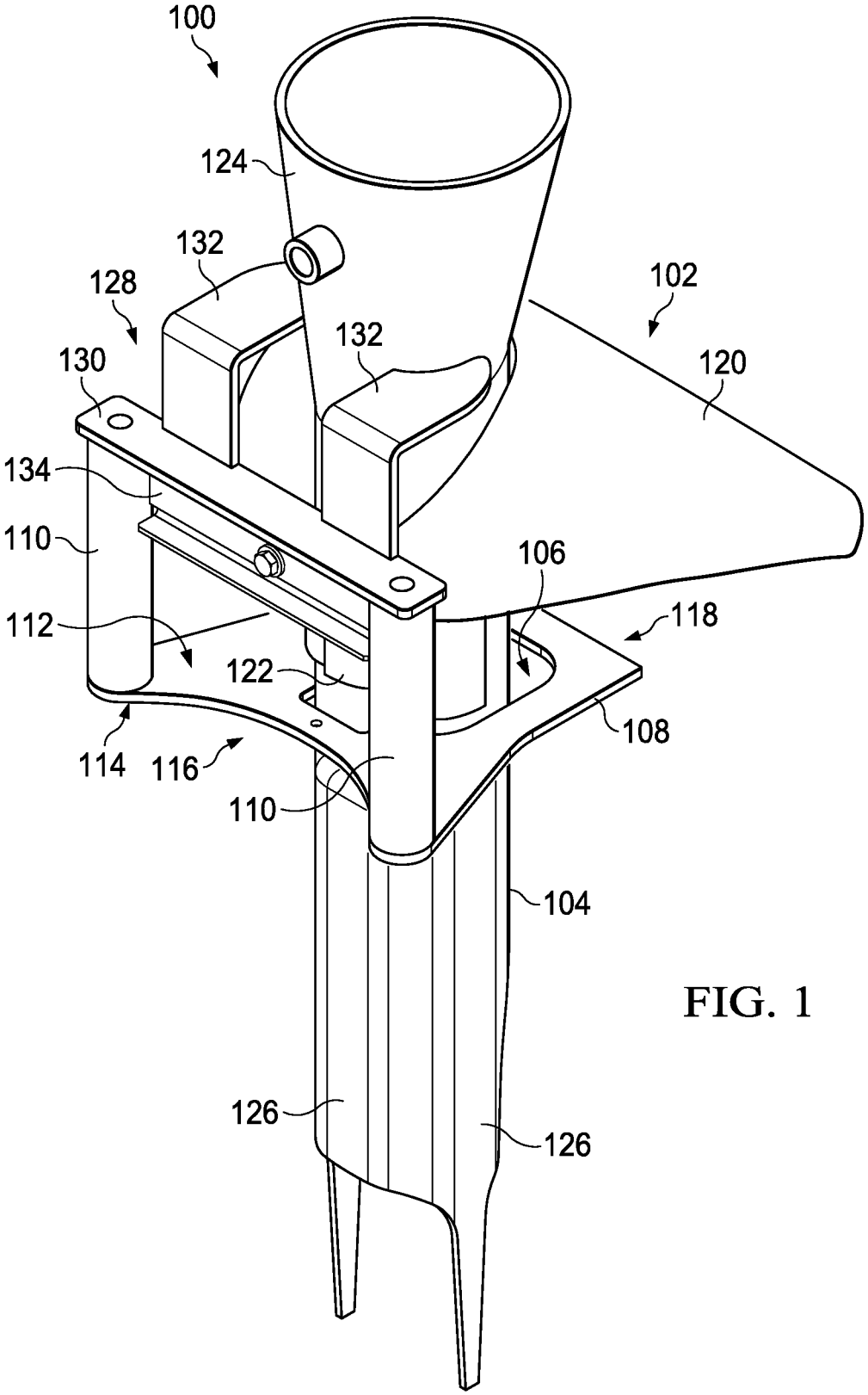
FIG. 1 is a perspective view of a former assembly in accordance with an illustrative embodiment.

Novel aspects of the present disclosure are directed to an improved former assembly and an improved bagmaker configured with the former assembly described herein. A former assembly is a critical component of a bagmaker which directs the flow of film laminate and also transitions the flat piece of film laminate into a tube of film that eventually forms a bag. During the bagmaking process, the former assembly also provides a channel for guiding carefully weighed charges of food pieces into the partially formed bags before the bags are sealed and separated from the tube of film.

The improved former assembly described herein recognizes the need for reducing the size and mass of conventional former assemblies because the size is proportionate to the amount of raw materials required and the cost of fabrication. Further, the size and weight contributes to operator fatigue during removal, installation, and transportation. Incidental damage over time causes former assembly misalignment that produces bags with unacceptable defects, such as wrinkles and ineffective seals. The larger former assemblies also require larger storage racks.

The improved former assembly also recognizes the need for relocating the center of gravity so that the former assemblies are easier to control. Existing former assemblies have an integrated base plate, often made from aluminum. In some conventional former assemblies, the base plate weighs over 5 kilograms and is more than one-third of the weight of the former assembly. The location of the base plate relative to the handles contributes to the undesirable center of gravity, which renders the former assemblies difficult to control. Moreover, different bagmakers may have different base plate mounts, sometimes requiring conventional former assemblies to be disassembled and reassembled onto another base plate compatible with another bagmaker. Thus, the improved former assembly described herein is designed with less mass and a particular weight distribution that relocates the center of gravity to make it easier to handle. In fact, embodiments disclosed herein describe a former assembly that is currently the lightest in the world. Additionally, the improved former assembly and bagmaker are redesigned to incorporate a uniform collar flange and novel base plate, respectively, which obviates the need to change base plates when changing former assemblies.

To facilitate the discussion and description of the various embodiments of the improved former assembly and bagmaker, certain descriptive conventions may be used to describe the relative position or location of various components. For example, the former assembly described herein is formed, at least in part, from a collar flange that defines a plane having an aperture passing through from one side of the collar flange to the other. Oriented perpendicularly to the collar flange is a transition tube having an elongate cylindrical body that extends through the aperture of the collar flange. When installed, the collar flange will be oriented horizontally or at least substantially horizontally and the transition tube will be oriented vertically or at least substantially vertically. Accordingly, relative descriptions will be made with reference to the former assembly in an installed configuration. Thus, the top of the transition tube may be described as separated from the bottom of the transition tube by the collar flange. In addition, the collar flange may be described as having a first side and a second side opposite to the first side, or an upper side and a lower side. Furthermore, the lateral position of the constituent components of the former assembly may be described relative to location of the handles, which are located at a proximate end of the collar flange or proximate side of the former assembly. In some embodiments the collar flange is shown as having a wider end and a narrower end, the wider end housing a set of handles; thus, the wider end of the collar flange may be alternatively described as the proximate end and the narrower end may be described as the distal end.

As used herein, the modifier "substantially" means "very close to." For example a collar flange that is orientated substantially horizontally means that the collar flange is mounted essentially horizontally or very close to horizontal. Thus, a collar flange that has "substantially horizontal" orientation can accommodate imprecise manufacturing tolerances or that may result in an orientation that is not perfectly horizontal, or when a perfectly horizontal orientation is not required. In one embodiment, a collar flange that is substantially horizontal may vary up to 5% or in some embodiments up to 10% of a reference value, such as an angle, length, or percentage. Thus, a substantially horizontal collar flange may deviate from a perfectly horizontal orientation (e.g., 180°) by as much as 9-18°.

FIG. 1 is a perspective view of a former assembly in accordance with an illustrative embodiment. The former assembly 100 may be generally described as having a wing assembly 102 coupled to a transition tube 104 that extends through an aperture 106 of a collar flange 108. A set of handles 110 may be provided to further secure the transition tube 104 to the collar flange 108, and to provide a means for moving and positioning the former assembly 100.

The collar flange 108 is a rigid but lightweight supporting structure to which the various components of the former assembly 100 are attached. As previously mentioned, the collar flange 108 has an aperture 106 passing through from a first side 112 of the collar flange 108 to a second side 114. In one embodiment, the collar flange 108 is shaped so that connecting each adjacent corner of the collar flange 108 to the next with an imaginary line defines a shape that can best be described as an isosceles trapezoid with the proximate end 116 being wider than a distal end 118. However, the shape of the collar flange 108 should be deemed exemplary and non-limiting. Thus, in another embodiment the collar flange 108 may be rectangular or triangular.

The wing assembly 102 includes a former wing 120 coupled to a crown tube 122. The crown tube 122 is a hollow cylindrical sleeve that extends through the aperture 106 of the collar flange 108. The diameter of the crown tube 122 should be sufficiently large to receive the transition tube 104 but small enough to pass through the aperture 106 of the collar flange 108 while leaving an annular gap between the edges of the aperture 106 and the outer surface of the crown tube 122. The annular gap permits the tube of film to pass between the crown tube 122 and the edges of the aperture 106 so the tube of film can pass from the first side 112 of the collar flange 108 to the second side 114.

Attached to the crown tube 122 is a former wing 120, which is a curved surface shaped and positioned to transition a flat piece of film into a tube of film that will be transformed into a pillow pouch bag. In one embodiment, the former wing 120 is shaped to define opening between a first shoulder and a second shoulder of the former wing 120, the opening being concentric with the opening in the crown tube 122.

Extending through the opening of the wing assembly 102 and also through the aperture 106 of the collar flange 108 is a transition tube 104. The transition tube 104 is an elongate structure, generally cylindrical in shape with a conical upper end 124 that facilitates the collection of carefully measured charges of food pieces, such a potato chips, pretzels, cereal, or other suitable comestibles, from a weigher (not shown). In addition, the transition tube 104 may include one or more planar belt pull regions 126 that provides a flat surface for engaging the tube of film and one or more pull down belts (not shown).

A set of handles 110 is located at the proximate end 116 of the collar flange 108, extending upwardly toward the conical upper end 124 of the transition tube 104. As used herein, the phrase "set of" means one or more. Thus, a set of handles 110 can be a single handle or two or more handles. However, in this illustrative embodiment in FIG. 1, the set of handles 110 includes two handles spaced apart at opposite corners of the proximate end 116 of the collar flange 108.

In one embodiment, the set of handles 110 is connected to the conical upper end 124 of the transition tube 104 by a stabilizer bracket 128. The stabilizer bracket 128 has a base 130 that can be attached to each of the set of handles 110. The stabilizer bracket 128 also includes one or more arms 132 extending from the base 130 towards the conical upper end 124 to attach the set of handles 110 to the conical upper end 124. In this illustrative embodiment in FIG. 1, the one or more arms 132 projects upwardly in the direction parallel to the set of handles 110 and then horizontally towards the conical upper end 124. The stabilizer bracket 128 provides additional structural support and rigidity to maintain proper alignment of the collar flange 108 and the transition tube 104. An optional stabilizer flange 134 may be attached to the stabilizer bracket 128 and/or the set of handles 110 to provide additional support. The stabilizer bracket 128 may be attached to the transition tube 104 by a horizontal stabilizer pin 136, which is more clearly visible in FIG. 2.

Figure 2:
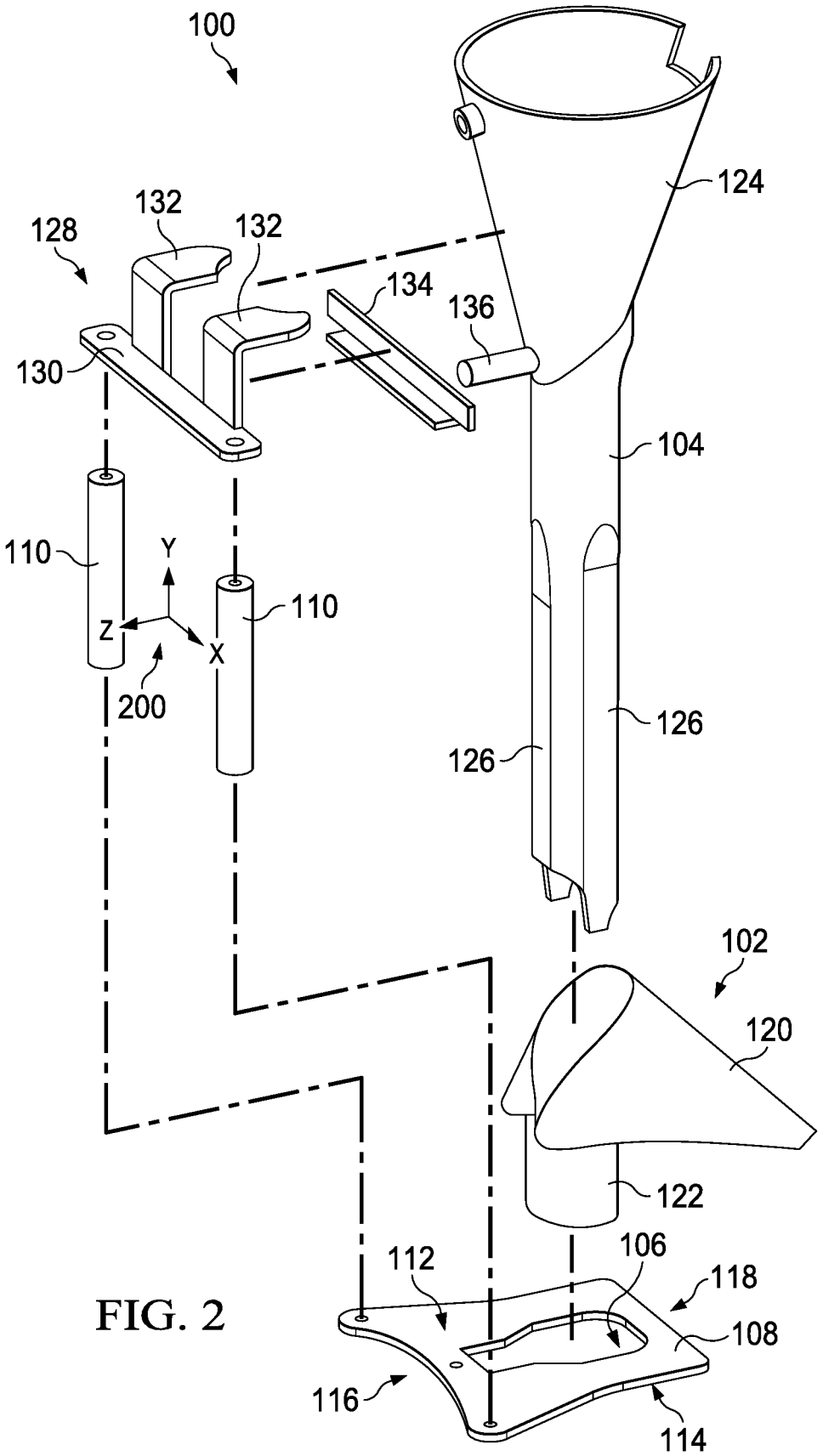
FIG. 2 is an exploded view of a former assembly in accordance with an illustrative embodiment.

FIG. 2 is an exploded view of the former assembly 100 depicted in FIG. 1, illustrating the manner in which the various components may be assembled to create former assembly 100. Also shown in FIG. 2 is reference coordinate system 200, which is an imaginary coordinate system used to define the location of a center of gravity of the former assembly 100 when held by a user. The reference coordinate system 200 has an origin positioned between each of the set of handles 110. More specifically, the reference coordinate system 200 is positioned substantially halfway between each of the handles and at a height that is located substantially halfway between the ends of the set of handles 110. The position of the reference coordinate system 200 corresponds generally to the location that is at a midpoint between each of a user's hands when the user grasps the set of handles 110 to lift the former assembly 100.

The reference coordinate system 200 depicts the positive direction of the x-axis, y-axis, and z-axis. The center of gravity for a 5-inch former assembly and an 11-inch former assembly according to the illustrative embodiment of FIG. 1 is shown in FIG. 3 and FIG. 4, respectively, relative to the reference coordinate system 200.

Figure 3:
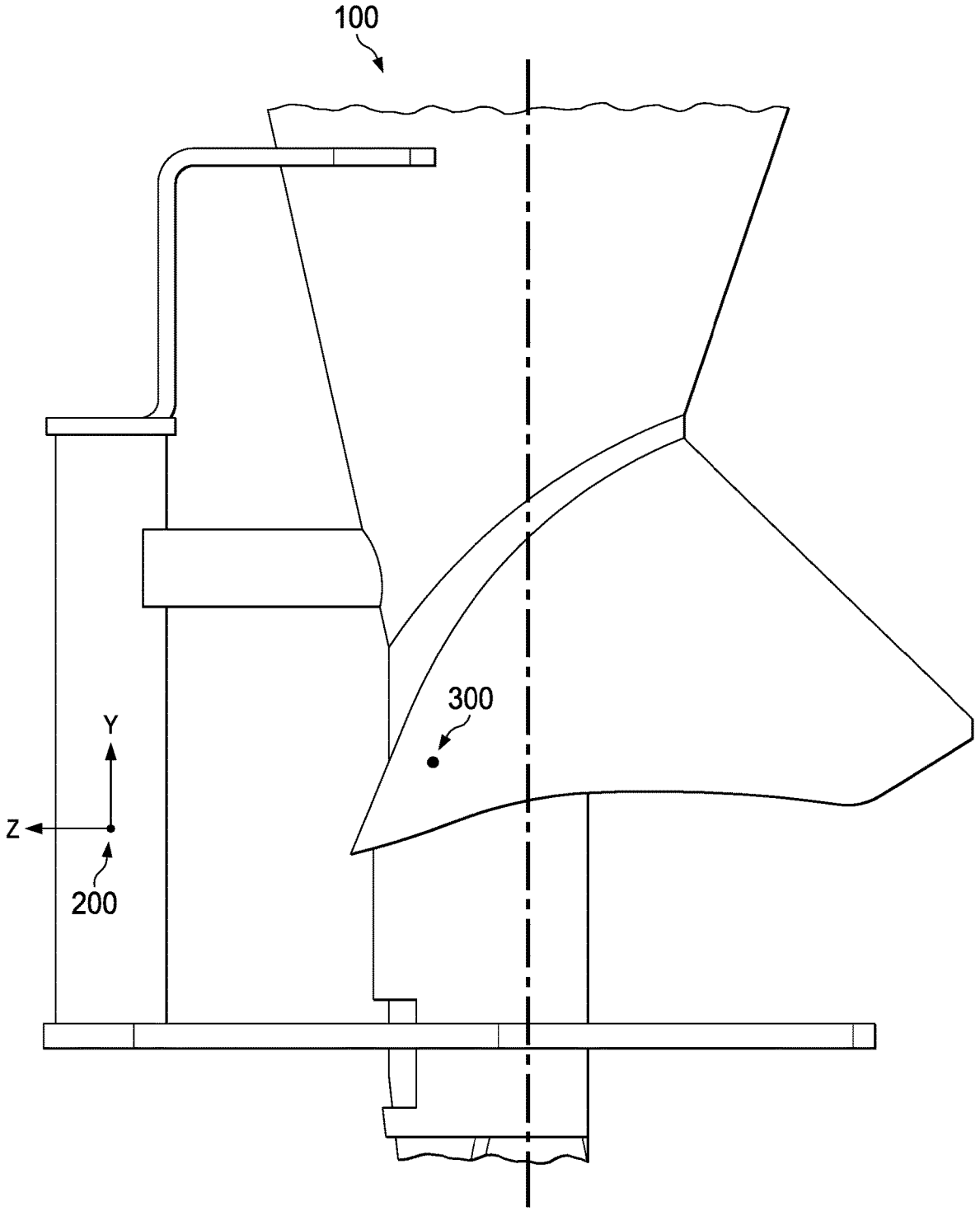
FIG. 3 is a side view of a 5-inch former assembly with corresponding center of gravity in accordance with the illustrative embodiment of FIG. 1.

FIG. 3 is a side view of a 5-inch former assembly with a corresponding center of gravity in accordance with the illustrative embodiment of FIG. 1. The former assembly 100 depicted in FIG. 3 includes the reference coordinate system 200 as well as the corresponding center of gravity 300. In this non-limiting example, the center of gravity 300 has an x-coordinate in the range between −0.06 mm to 0.02 mm, in a more preferred embodiment in the range between −0.04 mm to 0 mm, and in a most preferred embodiment the former assembly 100 has a center of gravity 300 with an x-component that is about −0.02 mm. The center of gravity 300 has a y-coordinate in the range between 25 mm to 36 mm, in a more preferred embodiment in the range between 28 mm to 33 mm, and in a most preferred embodiment the former assembly 100 has a center of gravity 300 with a y-coordinate that is about 31 mm. The center of gravity 300 has a z-coordinate in the range between −70 mm to −90 mm, in a more preferred embodiment in the range between −75 mm to −85 mm, and in a most preferred embodiment the former assembly 100 has a center of gravity 300 with a z-coordinate that is about −81 mm. Thus, in a most preferred embodiment, the former assembly 100 has a center of gravity 300 with (x, y, z) coordinates of about (0, 31, −81) mm relative to the reference coordinate system 200. Restated, the former assembly 100 of FIG. 3 may have a center of gravity 300 that has a y-coordinate that is no further than 33 mm from the y-axis of the reference coordinate system 200 in one embodiment, but in a most preferred embodiment, the center of gravity 300 that has a y-component that is located about 31 mm from the y-axis of the reference coordinate system 200. Likewise, the former assembly 100 of FIG. 3 may have a center of gravity 300 that has a z-coordinate that is no further than 90 mm from the y-axis of the reference coordinate system 200 in one embodiment, but in a most preferred embodiment, the center of gravity 300 that has a z-component that is located about 81 mm from the z-axis of the reference coordinate system 200.

In contrast, conventional 5-inch former assemblies have a center of gravity with (x, y, z) coordinates of about (0, −79, −84) mm relative to a similarly positioned reference coordinate system such as reference coordinate system 200. Because the center of gravity is located further away from a set of handles, the conventional former assemblies are more difficult to control. Thus, a comparative example of one embodiment of Applicant's former assembly 100 demonstrates that the center of gravity 300 is closer to the origin of the reference coordinate system 200, which results in a former assembly 100 that is easier to control.

Figure 4:
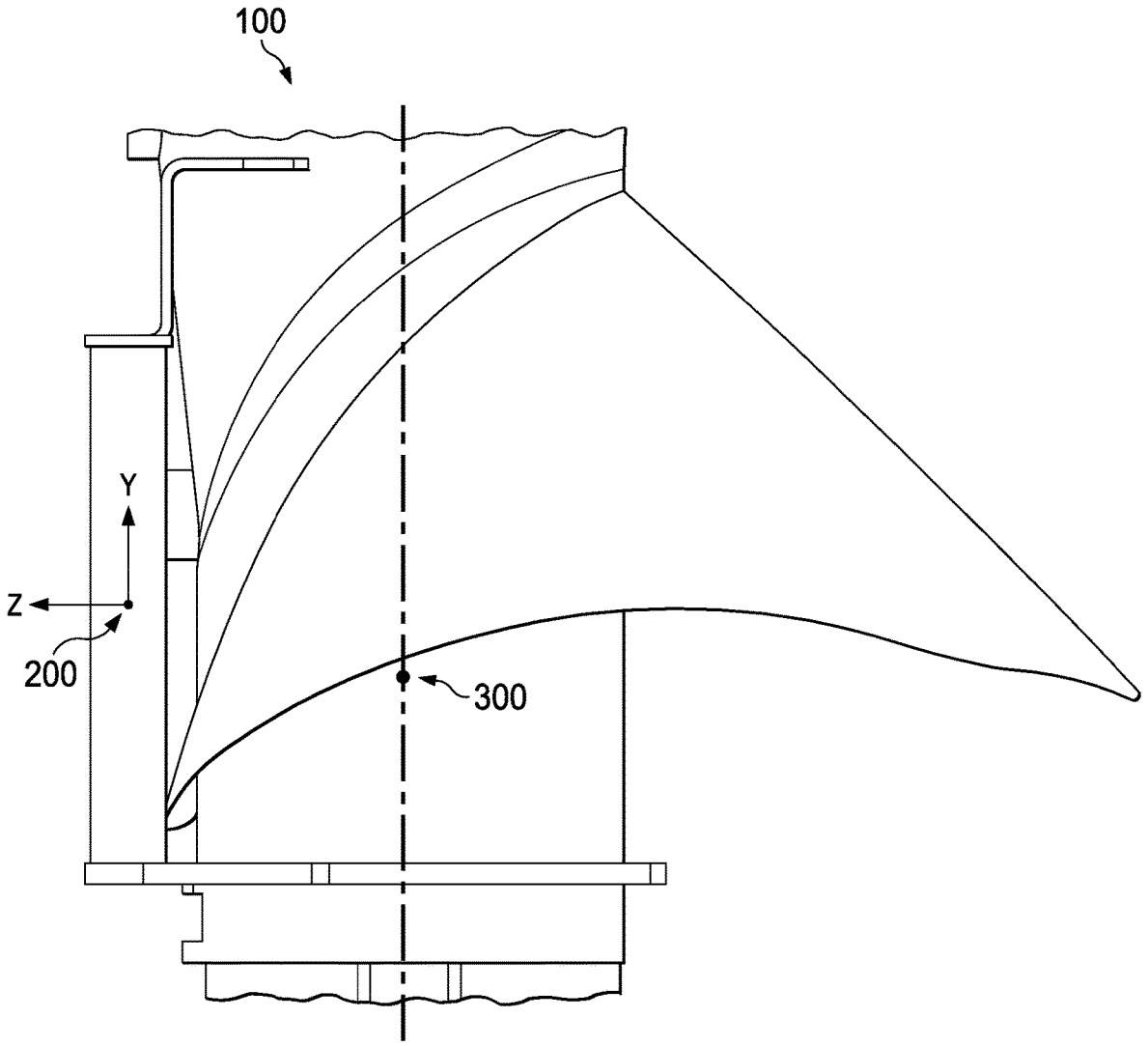
FIG. 4 is a side view of an 11-inch former assembly with corresponding center of gravity in accordance with the illustrative embodiment of FIG. 1.

FIG. 4 is a side view of an 11-inch former assembly with corresponding center of gravity in accordance with the illustrative embodiment of FIG. 1. The former assembly 100 depicted in FIG. 4 includes the reference coordinate system 200 as well as the corresponding center of gravity 300. In this non-limiting example, the center of gravity 300 has an x-coordinate in the range between −0.02 mm to 0.06 mm, in a more preferred embodiment in the range between 0 mm to 0.04 mm, and in a most preferred embodiment the former assembly 100 has a center of gravity 300 with an x-component that is about 0.02 mm. The center of gravity 300 has a y-coordinate in the range between −25 mm to −33 mm, in a more preferred embodiment in the range between −27 mm to −31 mm, and in a most preferred embodiment the former assembly 100 has a center of gravity 300 with a y-coordinate that is about −29 mm. The center of gravity 300 has a z-coordinate in the range between −101 mm to −121 mm, in a more preferred embodiment in the range between −106 mm to −116 mm, and in a most preferred embodiment the former assembly 100 has a center of gravity 300 with a z-coordinate that is about −111 mm. Thus, in a most preferred embodiment, the former assembly 100 in accordance with the non-limiting embodiment of FIG. 4 has a center of gravity 300 with (x, y, z) coordinates of about (0, −29, −111) mm relative to the reference coordinate system 200. Restated, the former assembly 100 of FIG. 4 may have a center of gravity 300 that has a y-coordinate that is no further than 33 mm from the y-axis of the reference coordinate system 200 in one embodiment, but in a most preferred embodiment, the center of gravity 300 that has a y-component that is located about 29 mm from the y-axis of the reference coordinate system 200. Likewise, the former assembly 100 of FIG. 4 may have a center of gravity 300 that has a z-coordinate that is no further than 121 mm from the z-axis of the reference coordinate system 200 in one embodiment, but in a most preferred embodiment, the center of gravity 300 that has a z-component that is located about 111 mm from the z-axis of the reference coordinate system 200.

In contrast, conventional 11-inch former assemblies have a center of gravity with (x, y, z) coordinates of about (0, −83, −141) mm relative to the origin of a similarly positioned reference coordinate system such as reference coordinate system 200. Because the center of gravity is located further away from a set of handles, the conventional former assemblies are more difficult to control. Thus, another comparative example of one embodiment of Applicant's former assembly 100 demonstrates that the center of gravity 300 is closer to the origin of the reference coordinate system 200, which results in a former assembly 100 that is easier to control.

Figure 5:
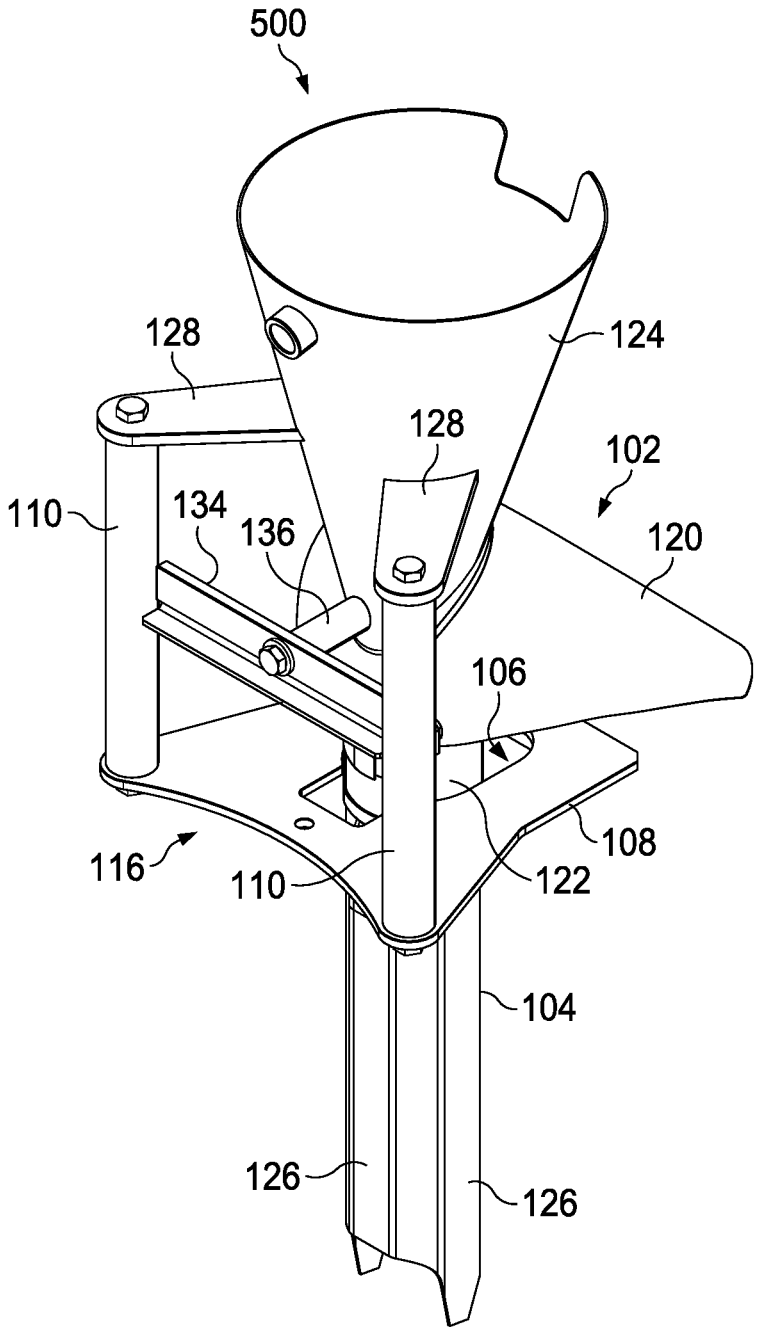
FIG. 5 is a perspective view of a former assembly in accordance with another illustrative embodiment.

FIG. 5 is a perspective view of a former assembly in accordance with another illustrative embodiment. Former assembly 500 may be generally described as having a wing assembly 102 coupled to a transition tube 104 that extends through an aperture 106 of a collar flange 108. A set of handles 110 may be provided to further secure the transition tube 104 to the collar flange 108, and to provide a means for moving and positioning the former assembly 500.

In this illustrative embodiment of FIG. 5, the set of handles 110 includes two handles that are spaced apart at opposite corners of the proximate end 116 of the collar flange 108. Each of the set of handles 110 extends upwardly toward the conical upper end 124 of the transition tube 104 and is connected to a corresponding number of stabilizer brackets 128 extending from the conical upper end 124 of the transition tube 104. In addition, an optional stabilizer flange 134 is attached to each of the set of handles 110 to provide additional support and rigidity. As with the former assembly 100 in FIG. 1, the stabilizer flange 134 of FIG. 5 is attached to the transition tube 104 by a stabilizer pin 136.

Figure 6:
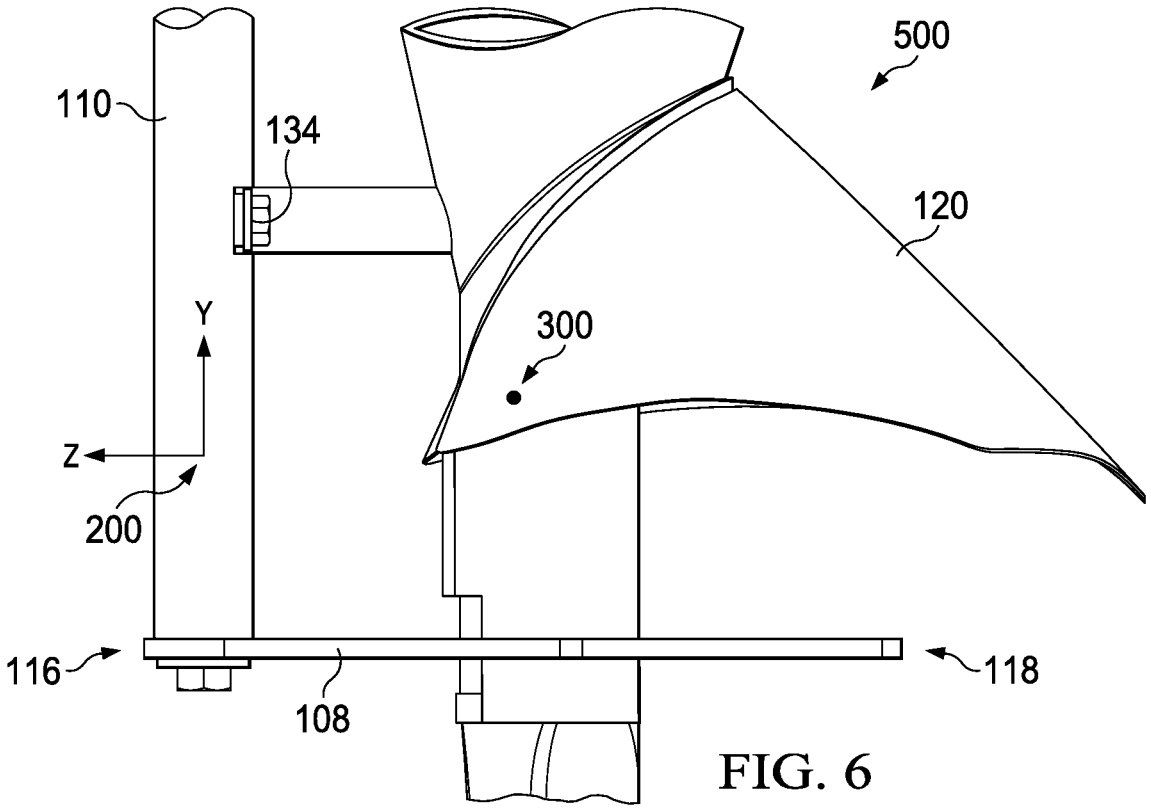
FIG. 6 is a side view of a 5-inch former assembly with corresponding center of gravity in accordance with the illustrative embodiment of FIG. 5.

FIG. 6 is a side view of a 5-inch former assembly 500 with corresponding center of gravity 300 in accordance with the illustrative embodiment of FIG. 5. The former assembly 500 has a mass in the range of 4.8-6.8 kilograms, and in a more preferred embodiment between 5.3-6.3 kilograms, and in a most preferred embodiment, the former assembly 500 has a mass of about 5.8 kilograms. The former assembly 500 depicted in FIG. 6 includes the reference coordinate system 200 as well as the corresponding center of gravity 300. The origin of the reference coordinate system 200 is located at a midpoint between the set of handles 110, and at a height that is halfway between the collar flange 108 and the stabilizer flange 134, which corresponds to a location between a user's hands when the user grasps the set of handles 110 to lift or reposition the former assembly 500. In this non-limiting example, the center of gravity 300 has an x-coordinate in the range between −4 to −16 mm, in a more preferred embodiment in the range between −7 to −13 mm, and in a most preferred embodiment the former assembly 500 has a center of gravity 300 with an x-component that is about −10 mm. The center of gravity 300 has a y-coordinate in the range between −5 to −11 mm, in a more preferred embodiment in the range between −7 to −9 mm, and in a most preferred embodiment the former assembly 500 has a center of gravity 300 with a y-coordinate that is about −8 mm. The center of gravity 300 has a z-coordinate in the range between −65 to −85 mm, in a more preferred embodiment in the range between −70 to −80 mm, and in a most preferred embodiment the former assembly 500 has a center of gravity 300 with a z-coordinate that is about −75 mm. Thus, in a most preferred embodiment, the former assembly 500 has a center of gravity 300 with (x, y, z) coordinates of about (−10, 7.8, −75) mm relative to the origin of the reference coordinate system 200. Restated, the former assembly 500 of FIG. 6 may have a center of gravity 300 that has an x-coordinate that is no further than 16 mm from the x-axis of the reference coordinate system 200, but in a most preferred embodiment, the center of gravity 300 has an x-coordinate that is located about 10 mm from the x-axis of the reference coordinate system 200. Additionally, the former assembly 500 of FIG. 6 may have a center of gravity 300 that has a y-coordinate that is no further than 11 mm from the y-axis of the reference coordinate system 200 in one embodiment, but in a most preferred embodiment, the center of gravity 300 has a y-component that is located about 7.8 mm from the y-axis of the reference coordinate system 200. Likewise, the former assembly 500 of FIG. 7 may have a center of gravity 300 that has a z-coordinate that is no further than 85 mm from the z-axis of the reference coordinate system 200 in one embodiment, but in a most preferred embodiment, the center of gravity 300 has a z-component that is located about 75 mm from the z-axis of the reference coordinate system 200.

The improved former assembly 500 has a reduced weight and smaller overall form factor with a repositioned center of gravity 300, relative to conventional former assemblies, which facilitates the handling of the former assembly 500. As previously discussed, the center of gravity 300 is located closer to the set of handles 110, where an operator grasps to lift the former assembly 500. The center of gravity is attributable to the mass of the various components of the former assembly 500 as well as their relative locations to one another. Given that the relative locations of the components of the former assembly 500 cannot be drastically changed without rendering the former assembly 500 unusable with existing bagmakers, dimensions and weights of the constituent components of former assembly 500 have been redesigned to reposition the center of gravity 300.

Relative to existing former wings for 5-inch former assemblies, former wing 120 of former assembly 500 has been modified to eliminate an overhanging area folded underneath the curved surface, which was previously used to secure the distal end of the former wing to the base plate. In addition, former wing 120 has been reduced in size to have dimensions of 226 mm by 298 mm, with a thickness of 0.8 mm, further reducing the mass of the former wing 120. The size reduction results in an overall decrease in mass of approximately 0.9 kg from an area towards the distal end 118 of the former assembly 500, shifting the center of gravity 300 towards the proximate end 116, closer to the set of handles 110. The size reduction of the former wing 120 has another added benefit, which is reducing the surface area of the former wing 120 in contact with film. Reduced contact between the film and the former wing 120 results in decreased friction, preserving the barrier properties of the film to increase the shelf-life of the packaged product, and also decreasing the amount of power required to pull the film over the former wing 120.

Similarly, collar flange 108 of former assembly 500 has been modified with generally smaller dimension to achieve a mass reduction of about 1.7 kg over conventional collar flanges of existing former assemblies. Moreover, the collar flange 108 has been redesigned with a proximate end 116 being wider than the distal end 118 to further shift the center of gravity 300 towards the origin of the reference coordinate system 200.

The largest contributor to the mass reduction of the former assembly 500 over the existing former assemblies is the omission of the base plate from the former assembly 500. By modifying the base plate with a universal collar flange mount and integrating the base plate to the bagmaker rather than former assembly 500, the former assembly 500 has a mass that is at least 5 kg less than existing former assemblies. Omission of the base plate in former assembly 500 contributes to the repositioning of the center of gravity 300 that is closer towards the origin of the reference coordinate system 200.

Other components of the former assembly 500 have been redesigned with strategic mass reductions that, as a whole contribute to the overall reduction in mass, but also contributes to result the repositioning of the center of gravity 300 closer towards the reference coordinate system 200, which results in a former assembly 500 that is easier to lift and manipulate. For example, the stabilizer flange 134 has a reduced thickness that results in a 16-18% reduction in mass, but provides adequate support because the stabilizer flange 134 is bent lengthwise to impart an L-shaped cross-section. Further, some existing former assemblies utilize a stabilizer flange that extends from the transition tube toward the proximate end of the base plate. In the redesigned former assembly 500, the stabilizer flange 134 is oriented substantially along the x-y plane and over the proximate end 116 of the collar flange 108 with each end attached to one handle.

Likewise, the transition tube 104 received a reduction in thickness to achieve a mass reduction of between 21-24%; the crown tube 122 received a reduction in thickness to achieve a mass reduction of between 28-32%; and each of the set of handles 110 received a mass reduction of between 18-22%.

Thus, in this illustrative example in FIG. 6, where the former assembly 500 is a 5-inch diameter former assembly 500 that has a mass in the range of 4.8-6.8 kilograms, more preferably between 5.3-6.3 kilograms, and most preferably with a mass of about 5.8 kilograms, the former assembly 500 includes a former wing 120 with mass in the range of 0.4-0.8 kilograms, and in a more preferred embodiment between about 0.5-0.7 kilograms, and in a most preferred embodiment the former assembly 500 has a former wing 120 with a mass of about 0.6 kilograms. Additionally, the 5-inch diameter former assembly 500 includes a stabilizer flange 134 with a mass in the range of 0.1-0.3 kilograms, and in a more preferred embodiment between 0.15-0.25 kilograms, and in a most preferred embodiment the former assembly 500 has a stabilizer flange 134 with a mass of about 0.2 kilograms. The 5-inch diameter former assembly 500 includes a collar flange 108 with a mass in the range of 1-2 kilograms, and in a more preferred embodiment between 1.25-1.75 kilograms, and in a most preferred embodiment the former assembly 500 has a collar flange 108 with a mass of about 1.5 kilograms. The 5-inch diameter former assembly 500 includes a transition tube 104 with a mass in the range of 1.75-2.65 kilograms, and in a more preferred embodiment between 2-2.4 kilograms, and in a most preferred embodiment, the former assembly 500 has a transition tube 104 with a mass of about 2.2 kilograms. (The mass of the stabilizer brackets 128 are included in the mass of the transition tube 104.) The 5-inch diameter former assembly 500 includes a crown tube 122 with a mass in the range of 0.5-0.9 kilograms, and in a more preferred embodiment between 0.6-0.8 kilograms, and in a most preferred embodiment, the former assembly 500 includes a crown tube 122 with a mass of about 0.7 kilograms. The 5-inch diameter former assembly 500 also includes a set of handles 110, with a combined mass in the range of 0.6-1.0 kilograms, and in a more preferred embodiment between 0.7-0.9 kilograms, and in a most preferred embodiment, the former assembly 500 has a set of handles 110 with a combined mass of about 0.8 kilograms. Lastly, the 5-inch diameter former assembly 500 includes a stabilizer pin 136 with a mass in the range of 0.02-0.04 kilograms, and in a more preferred embodiment between 0.025-0.035 kilograms, and in a most preferred embodiment, the former assembly 500 includes a stabilizer pin 136 with a mass of about 0.03 kilograms.

For the exemplary 5-inch diameter former assembly 500 described above, the range of masses for the various components may be alternatively described in terms of a mass percent. For example, the 5-inch diameter former assembly 500 may have a former wing 120 with a mass that is between 5-17% of the mass of the former assembly 500, and in a more preferred embodiment a mass between 7-14% of the mass of the former assembly 500, and in a most preferred embodiment the former wing 120 has a mass that is about 10% of the mass of the former assembly 500. Additionally, the 5-inch diameter former assembly 500 may have a stabilizer flange 134 with a mass that is between 1-7% of the mass of the former assembly 500, and in a more preferred embodiment a mass between 2-5% of the mass of the former assembly 500, and in a most preferred embodiment the stabilizer flange 134 has a mass that is about 3% of the mass of the former assembly 500. The 5-inch diameter former assembly 500 may have a collar flange 108 with a mass that is between 14-42% of the mass of the former assembly 500, and in a more preferred embodiment a mass between 19-33% of the mass of the former assembly 500, and in a most preferred embodiment the collar flange 108 has a mass that is about 26% of the mass of the former assembly 500. The 5-inch diameter former assembly 500 may have a transition tube 104 with a mass that is between 25-56% of the mass of the former assembly 500, and in a more preferred embodiment a mass between 31-46% of the mass of the former assembly 500, and in a most preferred embodiment the transition tube 104 has a mass that is about 38% of the mass of the former assembly 500. The 5-inch diameter former assembly 500 may have a crown tube 122 with a mass that is between 7-19% of the mass of the former assembly 500, and in a more preferred embodiment a mass between 9-16% of the mass of the former assembly 500, and in a most preferred embodiment the crown tube 122 has a mass that is about 12% of the mass of the former assembly 500. The 5-inch diameter former assembly 500 may have a set of handles 110 with a combined mass that is between 8-22% of the mass of the former assembly 500, and in a more preferred embodiment a mass between 10-18% of the mass of the former assembly 500, and in a most preferred embodiment the set of handles 110 has a combined mass that is about 14% of the mass of the former assembly 500. The 5-inch diameter former assembly 500 may have a stabilizer pin 136 with a mass that is between 0.3-0.7% of the mass of the former assembly 500, and in a more preferred embodiment a mass between 0.4-0.6% of the mass of the former assembly 500, and in a most preferred embodiment the stabilizer pin 136 has a mass that is about 0.5% of the mass of the former assembly 500.

Figure 7:
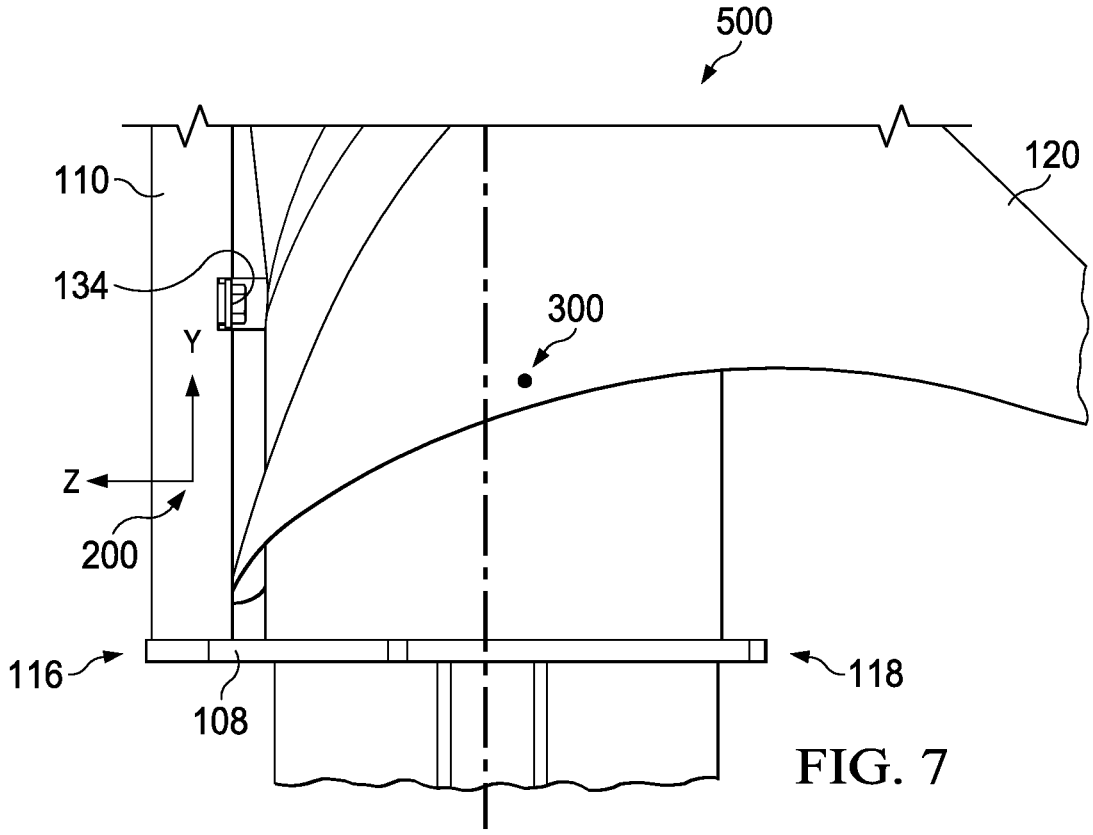
FIG. 7 is a side view of an 11-inch former assembly with corresponding center of gravity in accordance with the illustrative embodiment of FIG. 5.

FIG. 7 is a side view of an 11-inch former assembly 500 with corresponding center of gravity 300 in accordance with the illustrative embodiment of FIG. 5. The former assembly 500 has a mass in the range of 8.3-12.3 kilograms, and in a more preferred embodiment between 9.3-11.3 kilograms, and in a most preferred embodiment, the former assembly 500 has a mass of about 10.3 kilograms. The former assembly 500 depicted in FIG. 7 includes the reference coordinate system 200 as well as the corresponding center of gravity 300. The origin of the reference coordinate system 200 is located midway between the set of handles 110, and at a height that is halfway between the collar flange 108 and the stabilizer flange 134, which corresponds to a location between a user's hands when the user grasps the set of handles 110 to lift or reposition the former assembly 500. In this non-limiting example, the center of gravity 300 has an x-coordinate in the range between −5 to 5 mm, in a more preferred embodiment in the range between −2 to 2 mm, and in a most preferred embodiment the former assembly 500 has a center of gravity 300 with an x-component that is about 0 mm. The center of gravity 300 has a y-coordinate in the range between 23-43 mm, in a more preferred embodiment in the range between 28-38 mm, and in a most preferred embodiment the former assembly 500 has a center of gravity 300 with a y-coordinate that is about 33 mm. The center of gravity 300 has a z-coordinate in the range between −95 to −135 mm, in a more preferred embodiment in the range between −105 to −125 mm, and in a most preferred embodiment the former assembly 500 has a center of gravity 300 with a z-coordinate that is about −115 mm. Thus, in a most preferred embodiment, the former assembly 500 in accordance with the non-limiting embodiment of FIG. 7 has a center of gravity 300 with (x, y, z) coordinates of about (0, 33, −115) mm relative to the origin of the reference coordinate system 200. Restated, the former assembly 500 of FIG. 7 may have a center of gravity 300 that has an x-coordinate that is no further than 5 mm from the x-axis of the reference coordinate system 200 in one embodiment, but in a most preferred embodiment, the center of gravity 300 that has an x-component that is located on the x-axis of the reference coordinate system 200. Additionally, the former assembly 500 of FIG. 7 may have a center of gravity 300 that has a y-coordinate that is no further than 43 mm from the y-axis of the reference coordinate system 200 in one embodiment, but in a most preferred embodiment, the center of gravity 300 that has a y-component that is located about 33 mm from the y-axis of the reference coordinate system 200. Likewise, the former assembly 500 of FIG. 7 may have a center of gravity 300 that has a z-coordinate that is no further than 135 mm from the z-axis of the reference coordinate system 200 in one embodiment, but in a most preferred embodiment, the center of gravity 300 that has a z-component that is located about 115 mm from the z-axis of the reference coordinate system 200.

The center of gravity 300 is attributable to the mass of the various components of the former assembly 500 as well as their relative locations to one another. Given that the relative locations of the components of the former assembly 500 cannot be drastically changed without rendering the former assembly unusable with existing bagmakers, dimensions and weights of the constituent components of former assembly 500 have been redesigned to reposition the center of gravity 300.

Relative to existing former wings for 11-inch former assemblies, former wing 120 of former assembly 500 has been modified to eliminate an overhanging area folded underneath the curved surface, which was previously used to secure the distal end of the former wing to the base plate. In addition, former wing 120 has been reduced in size to have dimensions of 587 mm by 482 mm with a thickness of 0.8 mm, further reducing the mass of the former wing 120. The size reduction results in an overall decrease in mass of approximately 2 kg from an area towards the distal end 118 of the former assembly 500, shifting the center of gravity 300 towards the proximate end 116, closer to the set of handles 110. The size reduction of the former wing 120 has another added benefit, which is reducing the surface area of the former wing 120 in contact with film. Reduced contact between the film and the former wing 120 results in decreased friction, preserving the barrier properties of the film to increase the shelf-life of the packaged product, and also decreasing the amount of power required to pull the film over the former wing 120.

Similarly, collar flange 108 of former assembly 500 has been modified with generally smaller dimension to achieve a mass reduction of about 0.3 kg over conventional collar flanges of existing former assemblies. Moreover, the collar flange 108 has been redesigned with a proximate end 116 being wider than the distal end 118 to further shift the center of gravity 300 towards the origin of the reference coordinate system 200.

The largest contributor to the mass reduction of the former assembly 500 over the existing former assemblies is the omission of the base plate from the former assembly 500. By modifying the base plate with a universal collar flange mount and integrating the base plate to the bagmaker rather than former assembly 500, the former assembly 500 has a mass that is at least 2.4 kg less than existing former assemblies. Omission of the base plate in former assembly 500 contributes to a repositioning of a center of gravity 300 that is closer towards the origin of the reference coordinate system 200.

Other components of the former assembly 500 have been redesigned with strategic mass reductions or relocation that, as a whole contribute to the repositioning of the center of gravity 300 closer towards the reference coordinate system 200, which results in a former assembly 500 that is easier to control. For example, the stabilizer flange 134 is oriented substantially along the x-y plane and over the proximate end 116 of the collar flange 108 with each end attached to one handle. Likewise, the crown tube 122 received a reduction in thickness to achieve a mass reduction of between 28-32%; and the set of handles 110 received a mass reduction of between 4-7%.

Thus, in this illustrative example in FIG. 7, where the former assembly 500 is an 11-inch former assembly 500 that has a mass in the range of 8.3-12.3 kilograms, more preferably between 9.3-11.3 kilograms, and most preferably with a mass of about 10.3 kilograms, the former assembly 500 includes a former wing 120 with mass in the range of 1-2 kilograms, and in a more preferred embodiment between about 1.25-1.75 kilograms, and in a most preferred embodiment the former assembly 500 has a former wing 120 with a mass of about 1.5 kilograms. Additionally, the 11-inch former assembly 500 includes a stabilizer flange 134 with a mass in the range of 0.5-0.9 kilograms, and in a more preferred embodiment between 0.6-0.8 kilograms, and in a most preferred embodiment the former assembly 500 has a stabilizer flange 134 with a mass of about 0.68 kilograms. The 11-inch former assembly 500 includes a collar flange 108 with a mass in the range of 1-2 kilograms, and in a more preferred embodiment between 1.25-1.75 kilograms, and in a most preferred embodiment the former assembly 500 has a collar flange 108 with a mass of about 1.5 kilograms. The 11-inch former assembly 500 includes a transition tube 104 with a mass in the range of 3.8-5.8 kilograms, and in a more preferred embodiment between 4.3-5.3 kilograms, and in a most preferred embodiment, the former assembly 500 has a transition tube with a mass of about 4.8 kilograms. (The mass of the stabilizer brackets 128 are included in the mass of the transition tube 104.) The 11-inch former assembly 500 includes a crown tube 122 with a mass in the range of 1-2 kilograms, and in a more preferred embodiment between 1.25-1.75 kilograms, and in a most preferred embodiment, the former assembly 500 includes a crown tube 122 with a mass of about 1.5 kilograms. The 11-inch former assembly 500 also includes a set of handles 110 with a combined mass in the range of 0.6-1.0 kilograms, and in a more preferred embodiment between 0.7-0.9 kilograms, and in a most preferred embodiment, the former assembly 500 has a set of handles 110 with a combined mass of about 0.8 kilograms. The 11-inch former assembly 500 includes a stabilizer pin 136 with a mass in the range of 0.015-0.025 kilograms, and in a more preferred embodiment between 0.0175-0.0225 kilograms, and in a most preferred embodiment, the 11-inch former assembly 500 includes a crown tube 122 with a mass of about 0.02 kilograms.

For the exemplary 11-inch former assembly 500 described above, the range of masses for the various components may be alternatively described in terms of a mass percent. For example, the 11-inch former assembly 500 may have a former wing 120 with a mass that is between 8-24% of the mass of the former assembly 500, and in a more preferred embodiment a mass between 11-19% of the mass of the former assembly 500, and in a most preferred embodiment the former wing 120 has a mass that is about 14.6% of the mass of the former assembly 500. Additionally, the 11-inch former assembly 500 may have a stabilizer flange 134 with a mass that is between 4-11% of the mass of the former assembly 500, and in a more preferred embodiment a mass between 5-9% of the mass of the former assembly 500, and in a most preferred embodiment the stabilizer flange 134 has a mass that is about 6.6% of the mass of the former assembly 500. The 11-inch former assembly 500 may have a collar flange 108 with a mass that is between 8-24% of the mass of the former assembly 500, and in a more preferred embodiment a mass between 11-19% of the mass of the former assembly 500, and in a most preferred embodiment the collar flange 108 has a mass that is about 14.6% of the mass of the former assembly 500. The 11-inch former assembly 500 may have a transition tube 104 with a mass that is between 29-68% of the mass of the former assembly 500, and in a more preferred embodiment a mass between 26-55% of the mass of the former assembly 500, and in a most preferred embodiment the transition tube 104 has a mass that is about 44.7% of the mass of the former assembly 500. The 11-inch former assembly 500 may have a crown tube 122 with a mass that is between 8-24% of the mass of the former assembly 500, and in a more preferred embodiment a mass between 11-19% of the mass of the former assembly 500, and in a most preferred embodiment the crown tube 122 has a mass that is about 14.6% of the mass of the former assembly 500. The 11-inch former assembly 500 may have a set of handles 110 with a combined mass that is between 4-12% of the mass of the former assembly 500, and in a more preferred embodiment a mass between 6-10% of the mass of the former assembly 500, and in a most preferred embodiment the set of handles 110 has a combined mass that is about 7.8% of the mass of the former assembly 500. Lastly, the 11-inch former assembly 500 may have a stabilizer pin 136 with a mass that is between 0.1-0.3% of the mass of the former assembly 500, and in a most preferred embodiment the stabilizer pin 136 has a mass that is about 0.2% of the mass of the former assembly 500.

Figure 8:
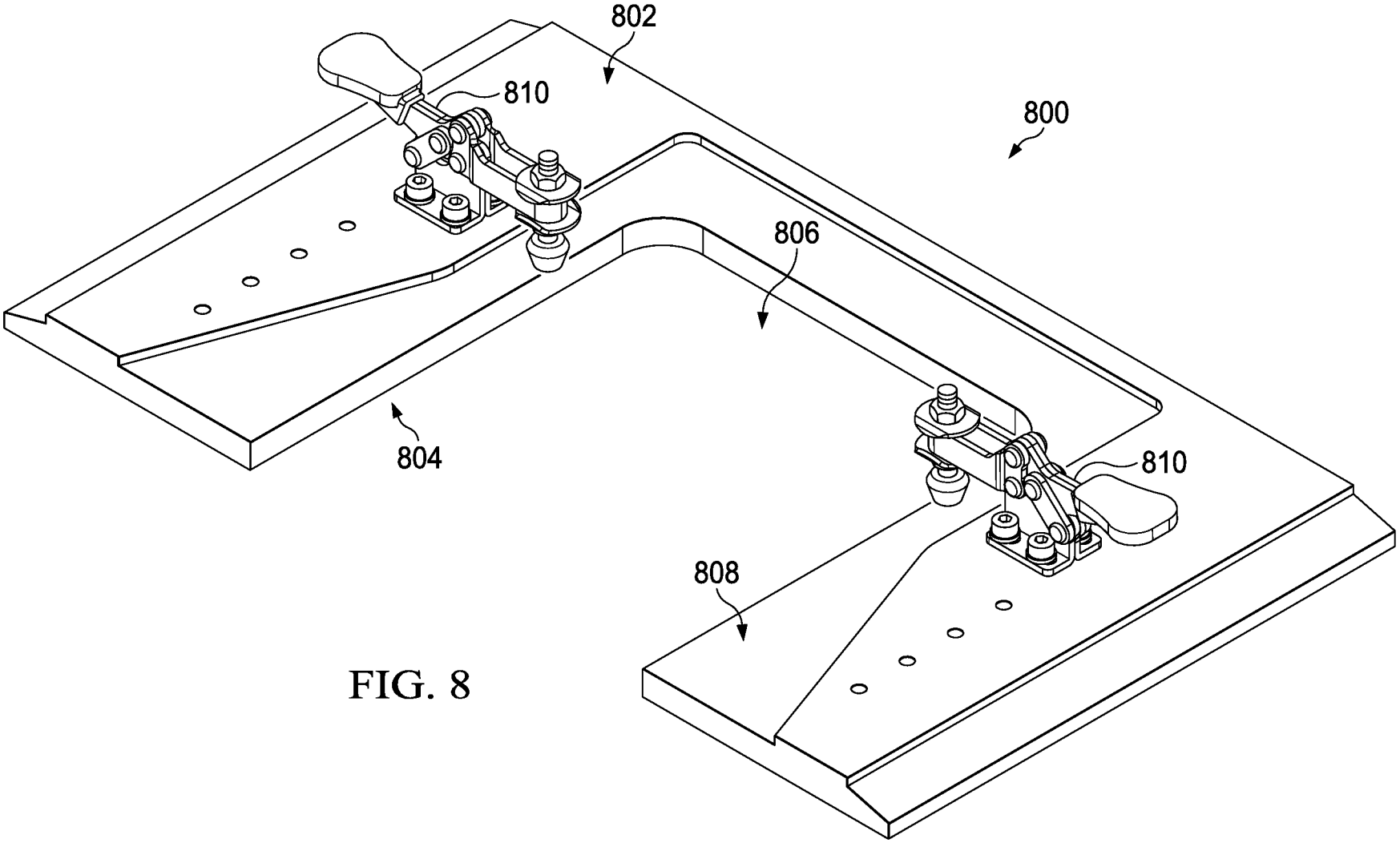
FIG. 8 is a perspective view of a base plate in accordance with an illustrative embodiment.

FIG. 8 is a perspective view of a base plate in accordance with an illustrative embodiment. Base plate 800 is a generally planar structural component that secures a former assembly to a bagmaker. The base plate 800 has a first surface 802 and a second surface 804, and is shaped to define a void space 806 surrounded on three sides by the base plate 800. Thus, the void space 806 extends from one edge of the base plate 800 towards the interior region of the base plate 800. The base plate 800 may be generally described as having a U-shaped form factor.

The base plate 800 includes a collar flange mount 808, which is a structural feature configured to receive and position a collar flange 108 of a former assembly onto the base plate 800. In this illustrative embodiment, the collar flange mount 808 is a sunken surface that forms a perimeter around the void space 806. The sunken surface corresponds to the footprint of a collar flange 108 so that a former assembly mounted to the base plate 800 will have its collar flange 108 seated within the sunken surface. When the edges of the collar flange 108 are positioned flush against the sidewalls that frame the sunken surface, then the former assembly 100 is properly mounted and aligned to reduce or eliminate the formation of defective bags. In another embodiment, the collar flange mount 808 may take another form, such as a set of rails disposed either side if the void space 806 and configured to guide a collar flange 108 into a proper location relative to the void space 806. In another embodiment, the collar flange mount 808 may be separate from the base plate 800 but in close enough proximity to position to engage and guide a collar flange 108 into the proper position.

The shape of the sunken surface obviates the need to precisely orient the collar flange 108 with the sunken surface during installation. For example, the sunken surface has a proximate end that is wider than a distal end. During installation, the collar flange 108 may be partially seated at the proximate end of the sunken surface so that the weight of the former assembly is supported by the base plate 800. Relatively less effort is required to slide the collar flange 108 into position to engage the sidewalls framing the sunken surface. In a contrasting example, if the sunken surface had a squared shape that corresponded exactly to a squared shape of a collar flange 108, then considerably more effort would be required of an operator to support the weight of the former assembly while attempting to guide the collar flange 108 into the sunken surface.

In this embodiment in FIG. 8, the base plate 800 includes a set of releasable fasteners 810. As used herein, the term "set of" may mean one or more. Thus a set of releasable fasteners 810 may be a single fastener or two or more fasteners. In this illustrative embodiment in FIG. 8, the set of releasable fasteners 810 is depicted as a pair of toggle clamps that can be operated by hand and without the need for tools. The set of releasable fasteners 810 is sufficient to secure a former assembly to the base plate 800 because the collar flange mount 808 already restricts the lateral movement of a collar flange 108 on the base plate 800. When the collar flange mount 808 is a sunken surface with an outline that at least partially corresponds to the footprint of the collar flange 108, the collar flange 108 is restricted from moving in three of the four possible directions. The mass of the former assembly, along with the downward force imposed by the set of releasable fasteners 810 is sufficient to maintain a collar flange 108 seated against the base plate 800 and within the collar flange mount 808.

Selective use of releasable fasteners 810 is one novel aspect that facilitates the installation and removal process of former assemblies in accordance with the present disclosure. Parts that are rarely interchanged may be fixedly combined, such as by welding, or mounted using tool-dependent fasteners, such as nuts and bolts. Thus, in one embodiment, the base plate 800 may be mounted to a bagmaker using conventionally available, but tool-dependent fasteners, such as clamps, bolts, or combinations thereof. The universal nature of the base plate 800 and the collar flange mount 808 obviates the need to change out the base plate 800 when a former assembly must be replaced to accommodate the creation of a different bag size or bag type. Likewise, former assemblies that are more frequently interchanged may be fastened to the base plate 800 by a releasable fastener 810 that can be operated quickly, easily, and without additional tools.

In a non-limiting embodiment, the base plate 800 may be formed from aluminum with a thickness between 10-14 millimeters, or in a more preferred embodiment a thickness between 11-13 millimeters, and in a most preferred embodiment, a thickness of 12 millimeters. In addition, the base plate 800 may have a mass of between 1-2 kilograms, and in a preferred embodiment the base plate 800 has a mass of about 1.5 kilograms. In a most preferred embodiment, the base plate 800 has a mass of 1.2 kilograms.

Figure 9:
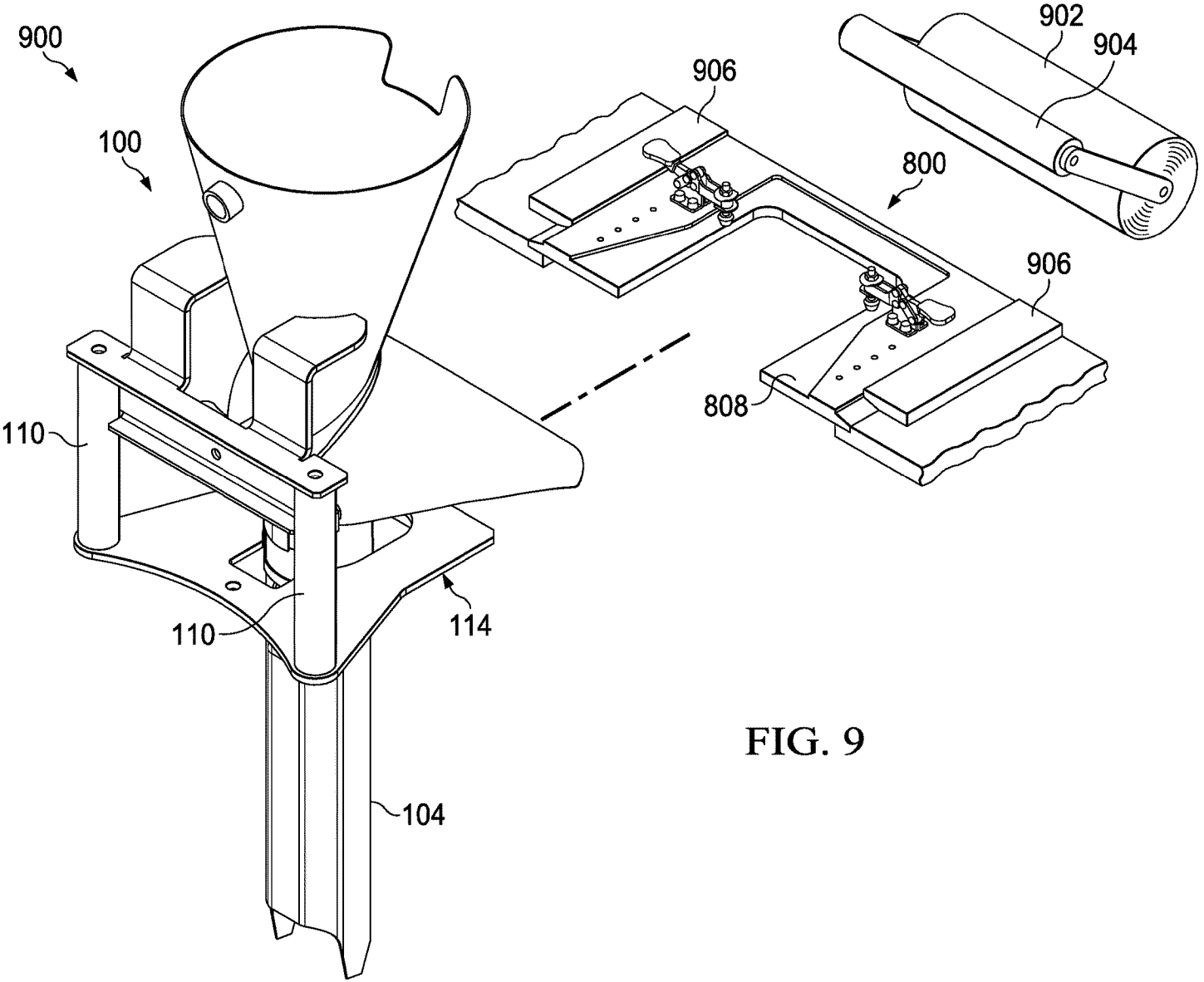
FIG. 9 is a perspective view depicting the installation of a former assembly in accordance with an illustrative embodiment.
Figure 10:
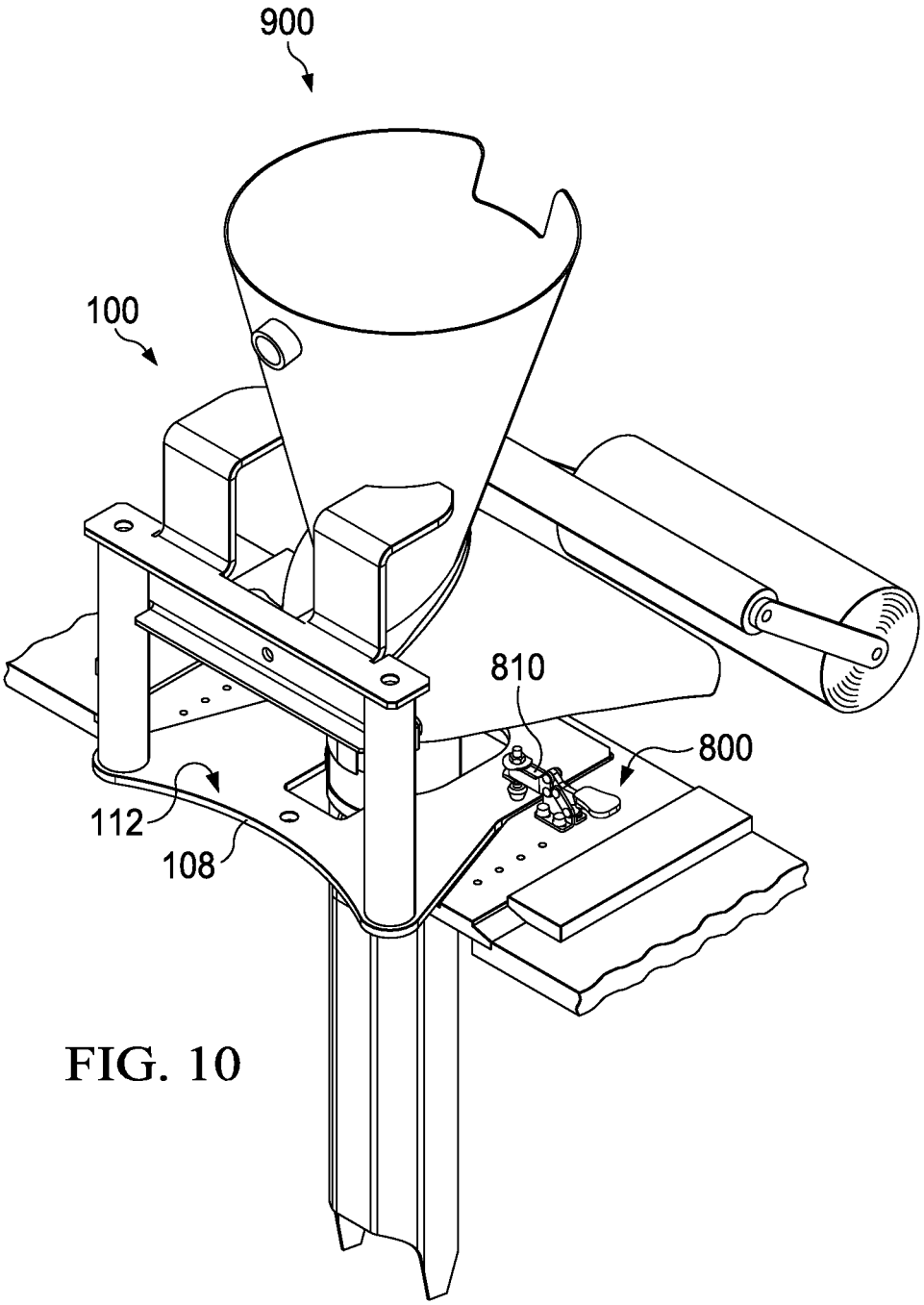
FIG. 10 is a perspective view of an installed former assembly in accordance with an illustrative embodiment.

FIG. 9 is a perspective view depicting the installation of a former assembly in accordance with an illustrative embodiment. In particular, the former assembly 100 is shown aligned with the base plate 800 so that the former assembly 100 may be guided into position on the base plate 800 to achieve the installed configuration shown in FIG. 10. In FIGS. 9 and 10, many of the details of the bagmaker have been omitted to reduce the complexity of the Figures. The omitted details of the bagmaker 900 are known to those having ordinary skill in the art. Nevertheless, additional details regarding bagmakers, and in particular vertical form, fill, and seal machines, can be found in U.S. Pat. No. 8,567,165, the subject matter of which is incorporated herein by reference in its entirety. However, for context, a roll of film 902 and a corresponding film tensioner 904 is depicted to show the relative orientation of the former assembly 100 relative to certain well-known components of the bagmaker 900.

Returning to FIG. 9, opposing sides of the base plate 800 are shown secured to a mounting location of the bagmaker 900, which corresponds generally to the mounting location of existing bagmakers. By retrofitting existing bagmakers with new mounts at the existing mounting location, or installing the base plate 800 at the existing mounting location without any further modification to the existing mounts, the improved former assembly 100 may be inserted into the bagmaker 900 without disrupting the bag-making and bag-filling process.

The base plate 800 may be mounted to the bagmaker 900 using any conventional means. In this illustrative embodiment, the opposing sides of the base plate 800 are secured to a mounting location by clamps 906. To mount the former assembly 100 onto the base plate 800, an operator grasping the set of handles 110 raises the former assembly 100 sufficiently high so that the second surface 114 of the collar flange 108 is at least partially seated on the collar flange mount 808. Thereafter, the former assembly 100 may be fully seated within the collar flange mount 808 of the base plate 800 by sliding the collar flange 108 into a position where the edges of the collar flange 108 are flush against the raised sidewalls framing the collar flange mount 808. Thus, the collar flange 108 is slidably engaged with the base plate 800, but more particularly the collar flange 108 is slidably engaged with the collar flange mount 808 of the base plate 800.

As can be seen in FIG. 9, the particular configuration of the void space 806 facilitates the installation and removal process by reducing the height to which the former assembly 100 is raised. In particular, former assembly 100 need only be raised to a height where the collar flange 108 is fractionally higher than the first surface 802 of the base plate 800. In contrast, if the base plate 800 were replaced with prior art base plates, which have an aperture fully enclosed by the base plate, the former assembly 100 would have to be raised sufficiently high so that the bottom of the transition tube 104 is higher than the first, upper surface of the prior art base plate, and then maneuvered to drop the transition tube 104 through the aperture to mount the former assembly 100 to the base plate. Significantly less effort is required to mount the former assembly 100 to the newly designed base plate 800.

Although the illustrative embodiment depicted in FIG. 9 shows the installation of former assembly 100, former assembly 500 could have been alternatively depicted. The collar flange mount 808 of the base plate 800 is sized to be able to receive any collar flange 108, regardless of the actual size or embodiment of the former assembly attached thereto.

FIG. 10 is a perspective view of an installed former assembly in accordance with an illustrative embodiment. With the collar flange 108 of the former assembly 100 properly positioned relative to the collar flange mount 808, the former assembly 100 is secured to the base plate 800 by the set of releasable fasteners 810. In this illustrative embodiment, the set of releasable fasteners engages an upper surface of the collar flange 108 and the collar flange 108 is maintained by frictional forces. Accordingly, the operative ends of each of the releasable fasteners 810, which is moved into contact with the first, upper surface 112 of the collar flange 108, is configured with a material that increases the coefficient of friction. As an example, the operative ends of the set of releasable fasteners 810 may be coated with rubber. Although not depicted, in another embodiment, the upper surface 112 of the collar flange 108 may include one or more apertures sized and positioned to receive the operative ends of each of the set of releasable fasteners 810 when the collar flange 108 is in the fully installed position. Such an embodiment may be preferred if the set of releasable fasteners 810 lack friction-increasing materials.

Additional Embodiments

The following clauses are offered as further description of the disclosed invention:

In a first embodiment, novel aspects of the invention are directed to former assembly comprising a collar flange, wherein the collar flange has an aperture passing through from a first side of the collar flange to a second side of the collar flange; a wing assembly mounted to the collar flange, wherein the wing assembly comprises a former wing and a crown tube, wherein the crown tube extends at least partially through the aperture of the collar flange; a transition tube having an elongate cylindrical body, wherein the elongate cylindrical body passes through the crown tube and the aperture of the collar flange; a set of handles extending from the collar flange towards an upstream end of the elongate cylindrical body; and wherein the former assembly comprises a center of gravity determined from a reference coordinate system with an origin located at a midpoint of the set of handles, and wherein the center of gravity has a y-component that is not further than 43 mm from the y-axis.

In another embodiment including any one or more elements of a previous embodiment disclosed above, the former assembly further comprising a stabilizer bracket, wherein a first end of the stabilizer bracket is coupled to the set of handles, and wherein a second end of the stabilizer bracket is coupled to the transition tube.

In another embodiment including any one or more elements of a previous embodiment disclosed above, wherein the former assembly further comprises a stabilizer flange, wherein the stabilizer flange is coupled to the set of handles.

In another embodiment including any one or more elements of a previous embodiment disclosed above, wherein the diameter of the transition tube is 5 inches and wherein the y-component of the center of gravity is between 5-11 mm from the y-axis.

In another embodiment including any one or more elements of a previous embodiment disclosed above, wherein the center of gravity has a z-component that is no further than 85 mm from the z-axis.

In another embodiment including any one or more elements of a previous embodiment disclosed above, wherein, wherein the z-component of the center of gravity is between 65-85 mm from the z-axis in the negative z-direction.

In another embodiment including any one or more elements of a previous embodiment disclosed above, wherein a diameter of the transition tube is 11 inches, and wherein the y-component of the center of gravity is between 23-43 mm from the y-axis.

In another embodiment including any one or more elements of a previous embodiment disclosed above, wherein the center of gravity has a z-component that is no further than 135 mm from the z-axis.

In another embodiment including any one or more elements of a previous embodiment disclosed above, wherein the z-component of the center of gravity is between 95-135 mm from the z-axis in the negative z-direction.

In another embodiment including any one or more elements of a previous embodiment disclosed above, wherein the former assembly has a mass in the range of 4.8-6.8 kilograms, and wherein the collar flange has a mass that is between 19-33% of the mass of the former assembly.

In another embodiment including any one or more elements of a previous embodiment disclosed above, wherein the former assembly has a mass in the range of 8.3-12.3 kilograms, and wherein the collar flange has a mass that is 8-24% of the mass of the former assembly.

In a second embodiment, novel aspects of the invention are directed to a novel bagmaker comprising a base plate and a former assembly slidably engaged to the base plate, wherein the former assembly comprises: a collar flange, wherein the collar flange has an aperture passing through from a first side of the collar flange to a second side of the collar flange; a wing assembly mounted to the collar flange, wherein the wing assembly comprises a former wing and a crown tube, wherein the crown tube extends at least partially through the aperture of the collar flange; a transition tube having an elongate cylindrical body, wherein the elongate cylindrical body passes through the crown tube and the aperture of the collar flange; a set of handles extending from the collar flange towards an upstream end of the elongate cylindrical body; and wherein the former assembly comprises a center of gravity determined from a reference coordinate system with an origin located at a midpoint of the set of handles, and wherein the center of gravity has a y-component that is not further than 43 mm from the y-axis.

In another embodiment including any one or more elements of a previous embodiment disclosed above, the bagmaker further comprising a stabilizer bracket, wherein a first end of the stabilizer bracket is coupled to the set of handles, and wherein a second end of the stabilizer bracket is coupled to the transition tube.

In another embodiment including any one or more elements of a previous embodiment disclosed above, the bagmaker further comprising a stabilizer flange, wherein the stabilizer flange is coupled to the set of handles.

In another embodiment including any one or more elements of a previous embodiment disclosed above, wherein the base plate comprises a void space extending from an edge of the base plate towards an interior of the base plate, and wherein the opening is sized to receive the cylindrical body of the transition tube.

In another embodiment including any one or more elements of a previous embodiment disclosed above, wherein the base plate further comprises a collar flange mount for positioning the collar flange on the base plate.

In another embodiment including any one or more elements of a previous embodiment disclosed above, wherein the collar flange mount is a sunken surface with a shape corresponding to a footprint of the collar flange.

In another embodiment including any one or more elements of a previous embodiment disclosed above, wherein the diameter of the transition tube is 5 inches and wherein the y-component of the center of gravity is between 5-11 mm from the y-axis.

In another embodiment including any one or more elements of a previous embodiment disclosed above, wherein the center of gravity has a z-component that is no further than 85 mm from the z-axis.

In another embodiment including any one or more elements of a previous embodiment disclosed above, wherein a diameter of the transition tube is 11 inches, and wherein the y-component of the center of gravity is between 23-43 mm from the y-axis.

In another embodiment including any one or more elements of a previous embodiment disclosed above, wherein the center of gravity has a z-component that is no further than 135 mm from the z-axis.

Although embodiments of the invention have been described with reference to several elements, any element described in the embodiments described herein are exemplary and can be omitted, substituted, added, combined, or rearranged as applicable to form new embodiments. A skilled person, upon reading the present specification, would recognize that such additional embodiments are effectively disclosed herein. For example, where this disclosure describes characteristics, structure, size, shape, arrangement, or composition for an element or process for making or using an element or combination of elements, the characteristics, structure, size, shape, arrangement, or composition can also be incorporated into any other element or combination of elements, or process for making or using an element or combination of elements described herein to provide additional embodiments. For example, it should be understood that the method steps described herein are exemplary, and upon reading the present disclosure, a skilled person would understand that one or more method steps described herein can be combined, omitted, re-ordered, or substituted.

Additionally, where an embodiment is described herein as comprising some element or group of elements, additional embodiments can consist essentially of or consist of the element or group of elements. Also, although the open-ended term "comprises" is generally used herein, additional embodiments can be formed by substituting the terms "consisting essentially of" or "consisting of."

While this invention has been particularly shown and described with reference to preferred embodiments, it will be understood by those skilled in the art that various changes in form and detail may be made therein without departing from the spirit and scope of the invention. The inventors expect skilled artisans to employ such variations as appropriate, and the inventors intend the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

We claim:

1. A former assembly comprising:

a collar flange, wherein the collar flange has an aperture passing through from a first side of the collar flange to a second side of the collar flange;

a wing assembly mounted to the collar flange, wherein the wing assembly comprises a former wing and a crown tube, wherein the crown tube extends at least partially through the aperture of the collar flange;

a transition tube having an elongate cylindrical body, wherein the elongate cylindrical body passes through the crown tube and the aperture of the collar flange;

a set of handles extending from the collar flange towards an upstream end of the elongate cylindrical body; and wherein the former assembly comprises a center of gravity determined from a reference coordinate system with an origin located at a midpoint between the set of handles, and wherein the center of gravity has a y-component that is not further than 43 mm from the origin along the y-axis.

2. The former assembly of claim 1, further comprising:

a stabilizer bracket, wherein a first end of the stabilizer bracket is coupled to the set of handles, and wherein a second end of the stabilizer bracket is coupled to the transition tube.

3. The former assembly of claim 1, further comprising:

a stabilizer flange, wherein the stabilizer flange is coupled to the set of handles.

4. The former assembly of claim 1, wherein the diameter of the transition tube is 5 inches and wherein the y-component of the center of gravity is between 5 and 11 mm from the origin along the y-axis.

5. The former assembly of claim 4, wherein the former assembly has a mass in the range of 4.8-6.8 kilograms, and wherein the collar flange has a mass that is between 19 and 33% of the mass of the former assembly.

6. The former assembly of claim 4, wherein the center of gravity has a z-component that is no further than 85 mm from the origin along the z-axis.

7. The former assembly of claim 6, wherein the z-component of the center of gravity is between 65 and 85 mm from the origin along the z-axis in the negative z-direction.

8. The former assembly of claim 1, wherein a diameter of the transition tube is 11 inches, and wherein the y-component of the center of gravity is between 23 and 43 mm from the origin along the y-axis.

9. The former assembly of claim 8, wherein the center of gravity has a z-component that is no further than 135 mm from the origin along the z-axis.

10. The former assembly of claim 8, wherein the z-component of the center of gravity is between 95 and 135 mm from the origin along the z-axis in the negative z-direction.

11. The former assembly of claim 8, wherein the former assembly has a mass in the range of 8.3-12.3 kilograms, and wherein the collar flange has a mass that is 8-24% of the mass of the former assembly.

12. The bagmaker of claim 1, further comprising:

a stabilizer flange, wherein the stabilizer flange is coupled to the set of handles.

13. A bagmaker comprising:

a base plate; and a former assembly slidably engaged to the base plate, wherein the former assembly comprises:

a collar flange, wherein the collar flange has an aperture passing through from a first side of the collar flange to a second side of the collar flange;

a wing assembly mounted to the collar flange, wherein the wing assembly comprises a former wing and a crown tube, wherein the crown tube extends at least partially through the aperture of the collar flange;

a transition tube having an elongate cylindrical body, wherein the elongate cylindrical body passes through the crown tube and the aperture of the collar flange;

a set of handles extending from the collar flange towards an upstream end of the elongate cylindrical body; and wherein the former assembly comprises a center of gravity determined from a reference coordinate system with an origin located at a midpoint of the set of handles, and wherein the center of gravity has a y-component that is not further than 43 mm from the origin along the y-axis.

14. The bagmaker of claim 13, further comprising:

a stabilizer bracket, wherein a first end of the stabilizer bracket is coupled to the set of handles, and wherein a second end of the stabilizer bracket is coupled to the transition tube.

15. The bagmaker of claim 13, wherein the base plate comprises a void space extending from an edge of the base plate towards an interior of the base plate, and wherein the opening is sized to receive the cylindrical body of the transition tube.

16. The bagmaker of claim 15, wherein the base plate further comprises a collar flange mount for positioning the collar flange on the base plate.

17. The bagmaker of claim 16, wherein the collar flange mount is a sunken surface with a shape corresponding to a footprint of the collar flange.

18. The bagmaker of claim 13, wherein the diameter of the transition tube is 5 inches and wherein the y-component of the center of gravity is between 5 and 11 mm from the origin along the y-axis.

19. The bagmaker of claim 18, wherein the center of gravity has a z-component that is no further than 85 mm from the origin along the z-axis.

20. The bagmaker of claim 13, wherein a diameter of the transition tube is 11 inches, and wherein the y-component of the center of gravity is between 23 and 43 mm from the origin along the y-axis.

21. The bagmaker of claim 20, wherein the center of gravity has a z-component that is no further than 135 mm from the origin along the z-axis.

* * * * *